US006141893A

United States Patent [19]

McCabe

[11] Patent Number: 6,141,893

[45] Date of Patent: Nov. 7, 2000

[54] LAUNDRY FEEDER METHOD AND APPARATUS

[75] Inventor: Stanley G. McCabe, Lubbock, Tex.

[73] Assignee: FinishTech, Ltd., Morton Grove, Ill.

[21] Appl. No.: 09/330,548

[22] Filed: Jun. 11, 1999

[51] Int. Cl.[7] ..... D06F 67/04

[52] U.S. Cl. ..... 38/143

[58] Field of Search ..... 38/143; 162/270, 162/271; 271/234, 235, 245

[56] References Cited

U.S. PATENT DOCUMENTS

| | | | |
|---|---|---|---|
| 3,376,036 | 4/1968 | Weir . | |
| 3,552,743 | 1/1971 | Baboz . | |
| 3,604,132 | 9/1971 | Thompson et al. . | |
| 3,664,046 | 5/1972 | Thompson . | |
| 3,729,846 | 5/1973 | Weir . | |
| 3,756,588 | 9/1973 | Gerstenberger | 38/143 |
| 3,772,808 | 11/1973 | Behn | 38/143 |
| 3,911,604 | 10/1975 | Sjostrom . | |
| 4,031,639 | 6/1977 | McCabe et al. | 38/143 |
| 4,143,476 | 3/1979 | Holmes et al. . | |
| 4,345,391 | 8/1982 | Weir . | |
| 4,378,645 | 4/1983 | Allen et al. . | |
| 5,333,402 | 8/1994 | Weir . | |
| 5,416,991 | 5/1995 | Jensen . | |
| 5,425,190 | 6/1995 | Jensen . | |
| 5,430,915 | 7/1995 | Ueda et al. . | |
| 5,440,810 | 8/1995 | Borucki et al. . | |
| 5,515,627 | 5/1996 | McCabe . | |
| 5,606,811 | 3/1997 | Jensen | 38/143 |

FOREIGN PATENT DOCUMENTS

| | | |
|---|---|---|
| 0 609 945 A1 | 8/1994 | European Pat. Off. . |

*Primary Examiner*—Ismael Izaguirre
*Attorney, Agent, or Firm*—Brinks Hofer Gilson & Lione; Craig A. Summerfield

[57] ABSTRACT

A laundry feeder method and apparatus for feeding laundry articles to a spreader apparatus is provided. The feeder allows large king size sheets, as well as other sized laundry articles, to be conveniently readied for spreading by a user. A fixed target is provided on the feeder. The user merely drapes a portion of the laundry article over the fixed target or inserts an edge of the article into a moveable clamp. The moveable clamp then moves along a track to the fixed target for clamping the laundry article. The clamp is then moved away from the fixed target, pulling the laundry article to the spreader, such as the spreader disclosed in U.S. Pat. No. 5,515,627. Multiple fixed targets and associated moveable clamps may be provided to increase the throughput.

29 Claims, 3 Drawing Sheets

LAUNDRY FEEDER METHOD AND APPARATUS

BACKGROUND OF THE INVENTION

The present invention relates generally to laundry feeding machines. In particular, an apparatus and method for feeding laundry articles to a spreader apparatus is provided.

In commercial laundry facilities, laundry articles, such as bed sheets, table linens, blankets, or the like are fed into a flatwork ironer and/or automatic folder after being washed. In order to obtain a neatly folded and unwrinkled laundry article, the laundry article should be presented to the ironer and/or folder with no wrinkles or folds and with the leading edge square.

One method for presenting the sheets with no folds employs operators to manually spread the sheet apart and to place the sheet in the ironer or folder by hand. However, the use of operators tends to slow the output of laundry processing equipment and can lead to inaccurate and inconsistent placement of the sheet. In addition, accurate placement of the sheet depends on the skill of the operators, so fatigued operators may increase costs.

To overcome the difficulties in using manual spreading, modem laundry facilities use automatic spreader-feeder machines. One machine of this type is disclosed in U.S. Pat. No. 5,440,810, assigned to the assignee of the present invention. These spreader-feeder machines typically include a continuous moving feed conveyor on which the sheets are automatically laid with their leading edges perpendicular to the conveyor belts. In order to position the sheet for placement onto the conveyor, a pair of spreading clamps are typically employed to grip opposing top corners of the sheet. A user manually inserts the corners into the clamps. The spreading clamps are then moved apart by one or more endless belts or cables to spread the sheet. Once the sheet is spread, the spreading clamps release the corners of the sheet, and the upper portion of the sheet is forced onto the conveyor. The conveyor then advances the sheet to the ironer or other processing equipment.

One disadvantage of many spreader-feeder machines is the time required for the operator to isolate the corners of the sheet and load these corners into the clamps. A spreader-feeder disclosed in U.S. Pat. No. 5,515,627, assigned to the assignee of the present invention, overcomes this disadvantage. The user merely isolates an edge and feeds the edge in between pinch rollers. The spreader-feeder machine then isolates the corners and spreads the sheet.

BRIEF SUMMARY

The present invention is defined by the following claims, and nothing in this section should be taken as a limitation on those claims. By way of introduction, the preferred embodiment described below includes a feeder method and apparatus for feeding laundry articles to a spreader. The feeder allows large king size sheets, as well as other sized laundry articles, to be conveniently readied for spreading by a user. A fixed target is provided on the feeder. The user merely drapes a portion of the laundry article over the fixed target or directly feeds a moveable clamp. A moveable clamp then moves along a track to the fixed target for clamping the laundry article. The clamp is then moved away from the fixed target, pulling the laundry article to the spreader, such as the spreader disclosed in U.S. Pat. No. 5,515,627. Multiple fixed targets and associated moveable clamps may be provided to increase the throughput.

In one aspect, a laundry feeder apparatus for processing laundry articles is provided. A fixed target is connected with a support. A moveable clamp moveably connects relative to the fixed target and is operable to clamp a laundry article draped on the fixed target. The moveable clamp is also operable to move away from the fixed target.

In another aspect, a method for feeding laundry articles is provided. A laundry article is draped over a fixed target. A clamp clamps the draped laundry article and moves with the laundry article away from the target.

In a third aspect, a fixed target operable to have a laundry article draped over the fixed target by a user is provided in a method for feeding laundry articles. A clamp clamps the draped laundry article at a portion of the article spaced from its edge. The laundry article is then moved away from the target. An apparatus for performing the above method is also provided.

The foregoing and other features and advantages of the invention will become further apparent from the following detailed description of the presently preferred embodiments, read in conjunction with the accompanying drawings.

DETAILED DESCRIPTION OF THE INVENTION

The figures are preferred embodiments for a feeder allowing more efficient processing and greater throughput for laundries. The user is able to merely drape a laundry article over a target without having to insert a particular edge or the corners. Alternatively, the user inserts an edge into the clamp. The feeder apparatus then takes over processing of the laundry article. The target is positioned as appropriate for the user, so laundry articles of various sizes may be used. For example, king size sheets may be merely draped over the target and the feeding apparatus raises the sheet from the floor for subsequent processing.

Figure 1:
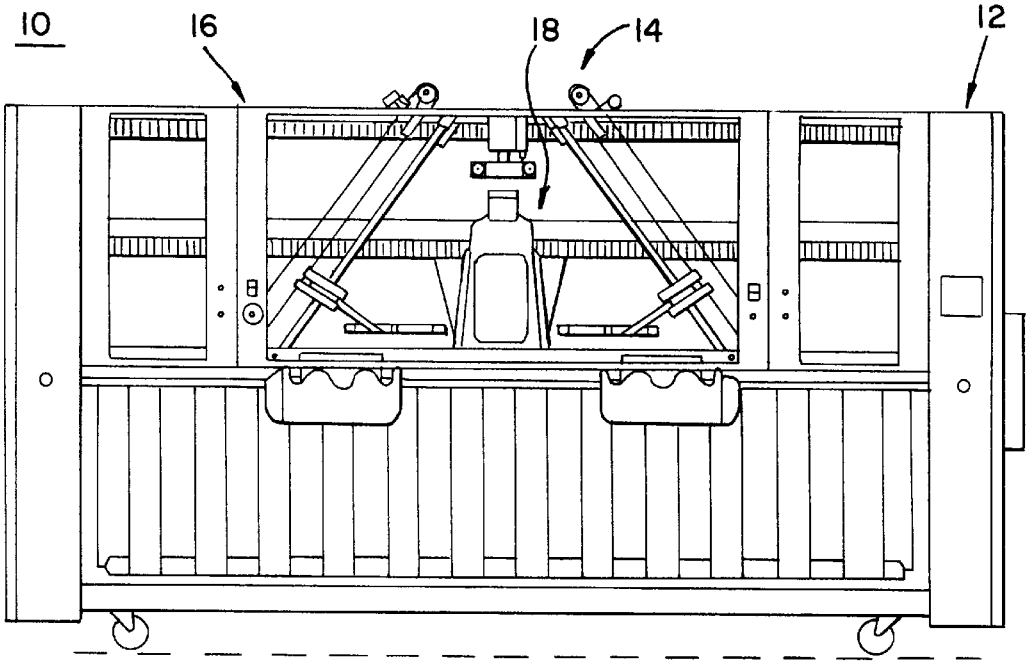
FIG. 1 is a front plan view of a presently preferred embodiment of a feeder-spreader combination apparatus.
Figure 2:
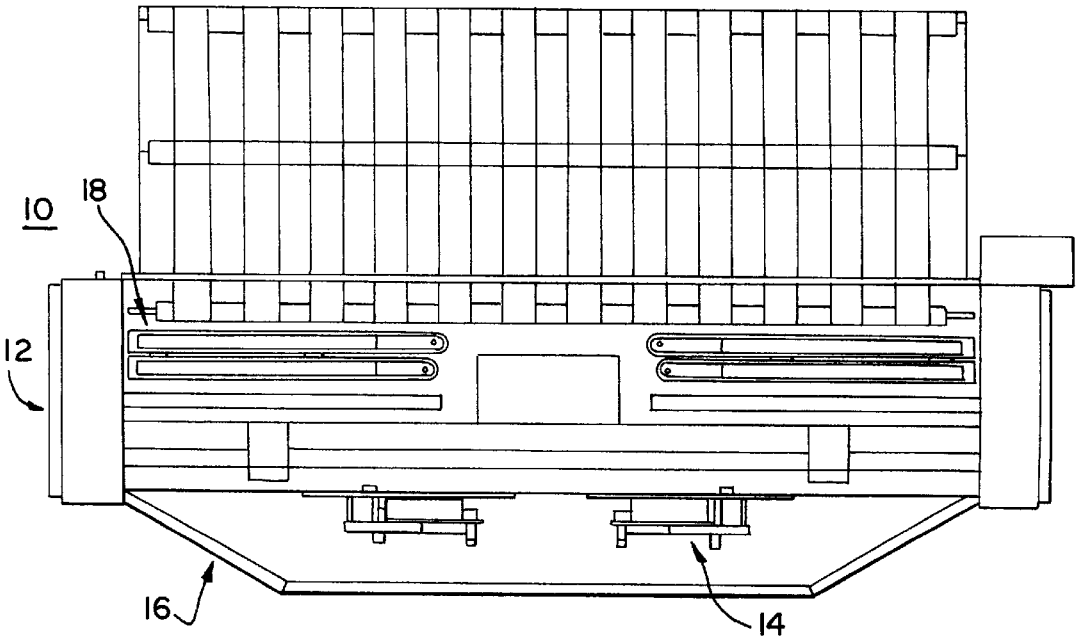
FIG. 2 is a top plan view of the feeder-spreader apparatus of FIG. 1.

Referring to FIGS. 1 and 2, front and top views of one preferred embodiment of a feeder-spreader is generally shown at 10. Feeder-spreader 10 includes a support structure 12, a feeder apparatus 14, a shield 16, and a spreader apparatus 18. The support structure 12 connects the feeder apparatus 14 to the spreader apparatus 18. The shield 16 prevents users from placing appendages near moving parts of the feeder apparatus 14 or the spreader apparatus 18.

The user provides articles of laundry to the feeder apparatus 14. The feeder apparatus 14 then automatically provides individual laundry articles to the spreader apparatus 18. The spreader apparatus 18 spreads the articles of laundry and lays them flat on a conveyor for subsequent laundry processing.

Figure 3:
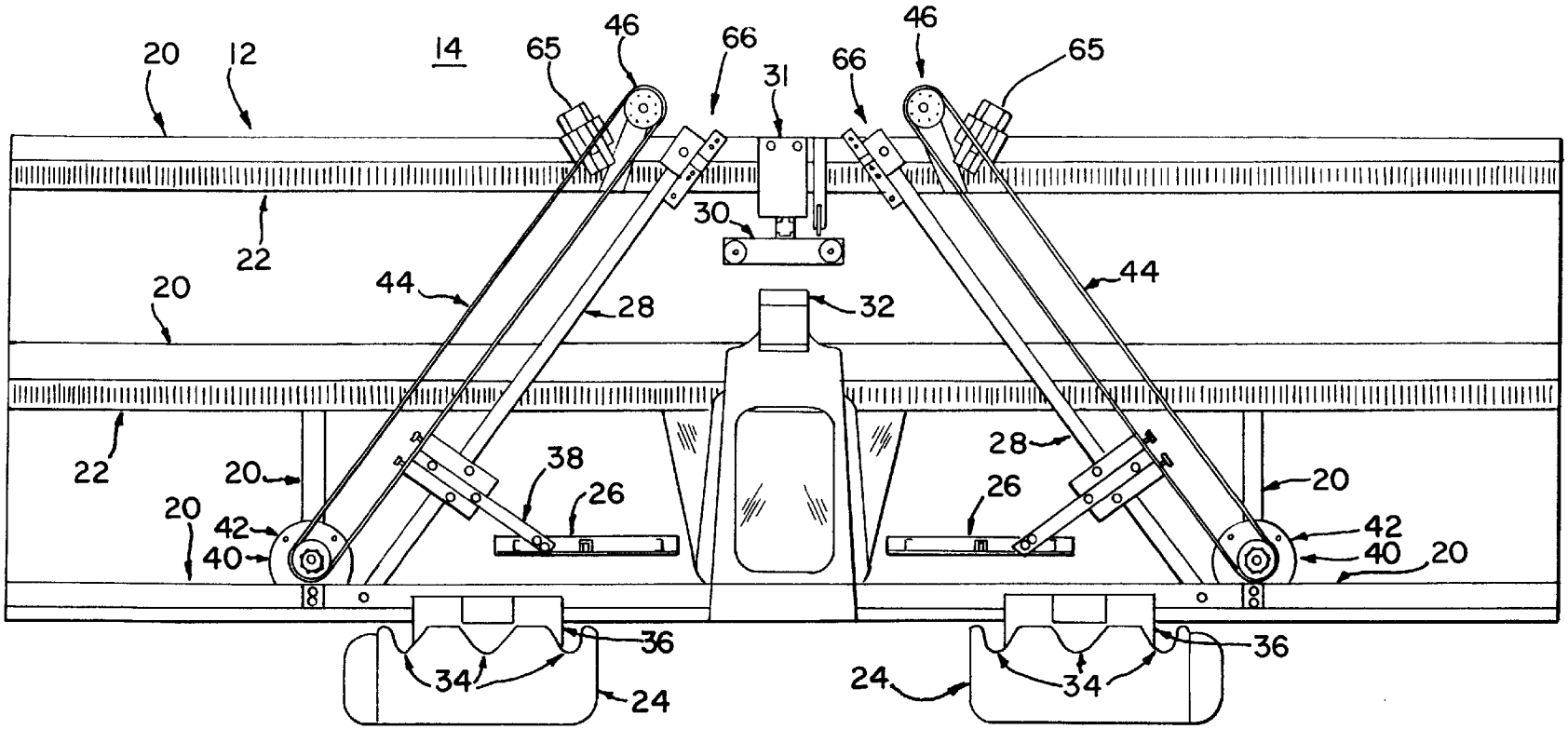
FIG. 3 is a plan view of one preferred embodiment of the feeder component.

Referring to FIG. 3, one preferred embodiment of the feeder apparatus 14 is shown. The feeder apparatus 14 includes a support structure 12, targets 24, clamps 26, tracks 28, and transfer clamp 30.

The support structure 12 comprises various beams 20 and optional guides 22. The beams 20 comprise angle iron or other structures for supporting the components of the feeder apparatus 14. The guides 22 house and organized various wires and pneumatic lines for operating the feeder apparatus 14. Any materials, such as metal, plastic, fiberglass, or wood, may be used to support of the components of the feeder apparatus 14.

The targets 24 are fixedly mounted to the support structure 12. The targets 24 comprise horizontally positioned sheet metal plates. Other materials, such as plastic, wood or fiberglass, may be used. By being fixedly mounted, the target 24 does not move relative to the support structure 12. The targets 24 are fixedly mounted to the support 12 by bolts, glue or welds. Preferably, extensions are used to hold the targets 24 spaced from the support structure 12. In one embodiment, the targets 24 are welded to a plate 36, and the plate 36 is bolted to the beam 20. The extensions or other connections from the target 24 to the support structure 12 connect at a lower portion of the target 24 in a preferred embodiment so that a laundry article may be draped over an upper portion of the target 24.

The target 24 is shaped so that there are no corners or other sharp components. The curved surfaces of the target 24 are less likely to rip and tear laundry articles. In one preferred embodiment, one vertical edge of the target 24 is angled to prevent the outside edge of the laundry article from catching on the target 24 as the article is lifted.

In one preferred embodiment, the target 24 is generally rectangular. Other shapes and structures may be used for the target 24, such as wire frames of any shape, other geometrical shapes, a single bar, and non-plate objects such as a block. While a painted surface is preferred, other surfaces may be used on the target 24, such as surfaces designed to provide friction with laundry articles.

The target 24 preferably includes three notches 34. Two outer notches 34 are shaped or adapted for allowing the clamp 26 to clamp an article of laundry draped over the target 24 without clamping the target 24. The center notch 34 is adapted to allow a light beam of a laundry article sensor 56 to pass through the target 24 and impede upon a non-reflective surface, such as provided on the plate 36. The notch 34 for the laundry article sensor 56 may comprise an aperture or notch 34 positioned anywhere on the target 24. Preferably, the clamp notches 34 are positioned on opposite ends of the target 24, but may be positioned with less spacing between the notches 34 and at different locations on the target 24. In alternative embodiments, more or fewer notches are provided.

The moveable clamp 26 comprises a support structure 38 and a drive structure 40. The moveable clamp support structure 38 is connected to the drive structure 40.

In one preferred embodiment, the drive structure 40 comprises an electrical motor 42, a wheel 46 and an endless chain or belt 44 connected around an axle or wheel of the motor 42 and the wheel 46. Preferably, the belt 44 comprises a timing belt with an inverter. In alternative embodiments, a pneumatic actuator or extending screw device with an electric motor are used for moving the moveable clamp 26. In yet other alternative embodiments, a rotating arm, large rotating wheel, a chain or belt with an end or other device for moving the clamp 26 from the moveable target 24 to the transfer clamp 30 is used. Preferably, a fail safe brake 65 is provided for the belt 44. The fail safe brake 65 prevents the moveable clamp 26 from falling to the target 24 in case of a power failure.

In a preferred embodiment, the track 28 guides the moveable clamp 26. Preferably, the track 28 is a rectangular metallic structure, but other materials such as those discussed above may be used. The track 28 may comprise a grooved track or cylindrical track for guiding the clamp 26. The track 28 may be placed at an angle from the target 24 to the transfer clamp 30, such as at the angle shown or a vertical position. The track 28 may also be angled away or towards the front or back of the feeder spreader 10.

Figure 4:
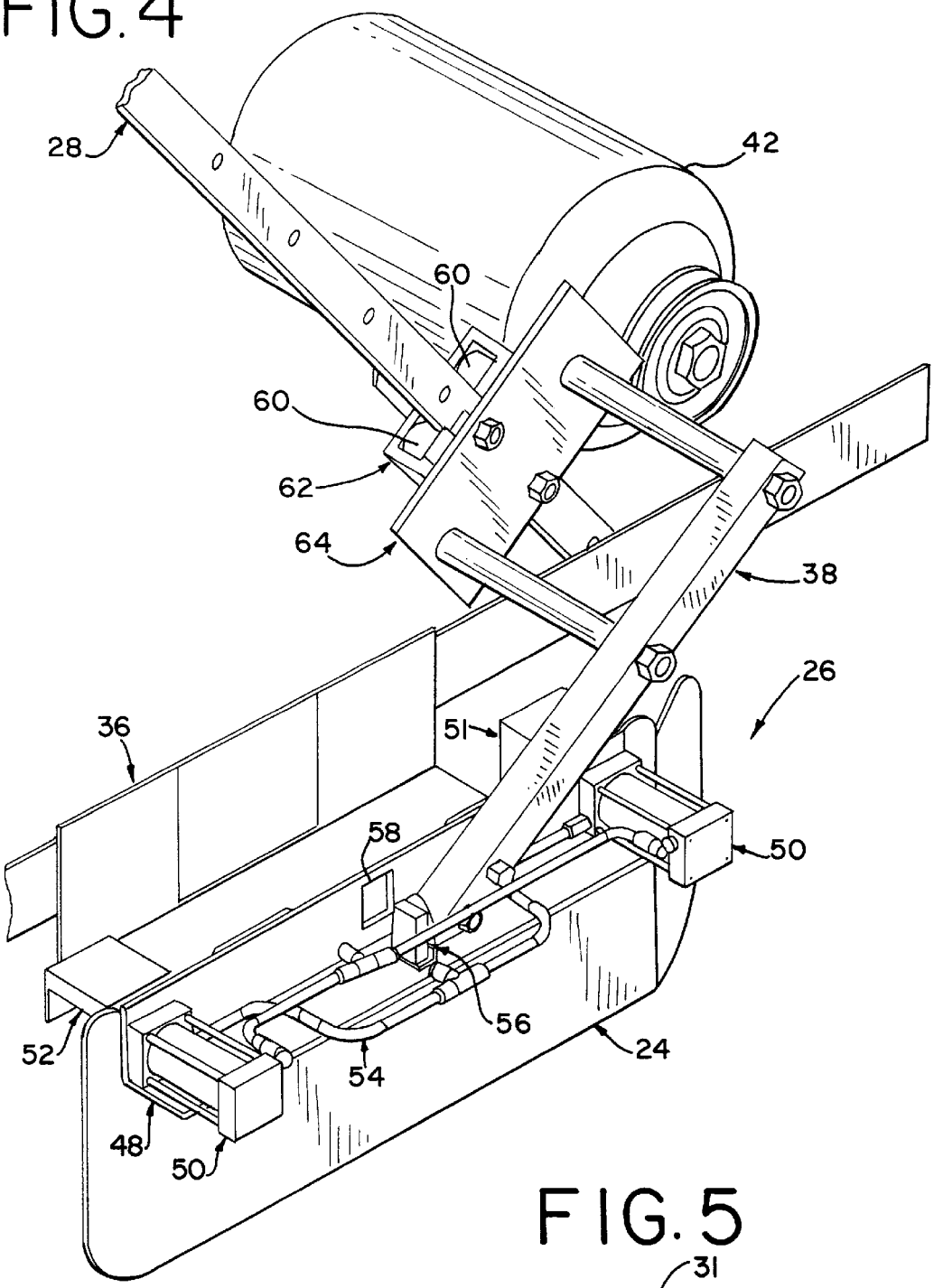
FIG. 4 is a perspective view of one preferred embodiment of a clamp mechanism.

Referring to FIG. 4, a preferred embodiment of the clamp 26 is shown. The clamp 26 comprises two pneumatic actuators 50 and respective L-brackets 52. Pneumatic lines 54 actuate each pneumatic actuator 50 to extend a plunger against the respective L-bracket 52. By extending the plunger against the L-bracket 52, an article of laundry is clamped. The pneumatic lines 54 are connected through a flexible pneumatic line to a pneumatic pump (not shown). More or fewer pneumatic actuators 50 may be provided for clamping the laundry article. In alternative embodiments, an electrically activated solenoid or other mechanically powered devices are used for clamping the laundry article. Other clamping structures may be used, such as two moveable pinchers, one rotatably connected pincher, pinch rollers, or other devices.

The pneumatic actuators 50 are connected through bolts or welds to angle iron 48 in a spaced relationship. The spacing between the actuators 50 corresponds to the spacing of the notches 34 on the target 24. When the moveable clamp 26 is in the lowermost position, the actuators 50 and L-brackets 52 line up adjacent to the notches 34 of the target 24. Other structures for supporting and spacing the actuators 50 may be used, such as structures using the materials discussed above.

The angle iron 48 also holds the laundry article sensor 56 in a position to sense an article of laundry draped over the target 24. The laundry article sensor 56 comprises a light beam sensor for transmitting a beam of light and receiving any reflection. In the preferred embodiment, an aperture 58 is provided through the angle iron 48. A notch or different positioning of the laundry article sensor 56 may be provided in alternative embodiments. The laundry article sensor 56 comprises a light beam sensor for transmitting a beam of light and receiving any reflection. In this embodiment, the beam of light passes from the laundry article sensor 56 through the aperture 58 to the plate 36.

The laundry article sensor 56 and the aperture 58 are positioned adjacent to the center notch 34 of the target 24 when the moveable clamp 26 is at the lower most position. If a laundry article is draped over the target 24, the light beam is reflected from the laundry article to the sensor 56. Detection of the article of laundry draped over the target 24 is used to activate the pneumatic actuators 50 for clamping the article of laundry.

The clamp 26 is moveably connected to the track 28. In a preferred embodiment, the angle iron 48 is connected to the support structure 38, and the support structure 38 is connected to the track 28. Preferably, bolts are used, but welds or other connections may be used. In alternative embodiments, the angle iron 48 and the support structure 38 comprise a single formed piece. The support structure 38 is connected to the track 28 with a plate 64, a bracket 62, and wheels 60. The bracket 62 connects to the plate 64 and surrounds the track 28. The wheels 60 are rotatably connected to the bracket 62 on opposite sides of the track 28. The wheels 60 rotate along the track 28 as the moveable clamp 26 is moved towards or away from the target 24. The plate 64 preferably connects to the belt or chain 44 (FIG. 3). In one embodiment, bolts through plate 64 are used to pinch two ends of the belt 44, such as a timing belt, together to form an endless loop. Other connections for guiding the moveable clamp 26 may be used, such as ball bearing, friction guides without wheels, or using no track 28 and guiding the moveable clamp 26 with the drive mechanism, such as the belt 44, an extending arm, screw mechanism or a rotatable arm.

Referring now to FIG. 3, the moveable clamp 26 is adjacent the target 24 at one end of the track 28. At the other end of the track 28, the moveable clamp 26 is adjacent the transfer clamp 30. A proximity sensor 66 senses the presence of the metal support 38 of the moveable clamp 26 to indicate a proper position on the upper end of the track 28. Other sensors may be used, such as a position activated trigger, an electric eye or light beam sensor, a shock absorber, plunger or other devices. One or more of these devices may be used for positioning the moveable clamp 26 adjacent the target 24. In one embodiment, an adjustable shock absorber is positioned so that bracket 62 or another portion of the moveable clamp 26 is stopped at a position for gripping.

Figure 5:
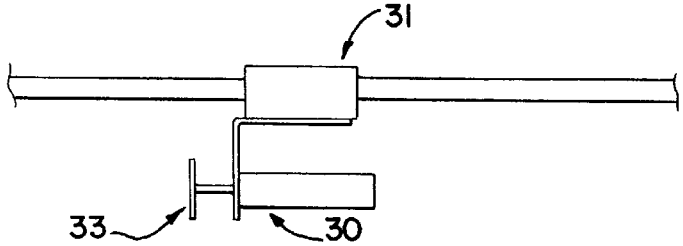
FIG. 5 is a side plan view of one preferred embodiment of a transfer clamp.

Referring to FIGS. 3 and 5, once the moveable clamp 26 is in the upwardmost position, the transfer clamp 30 is activated. The transfer 30 clamp preferably comprises two pneumatically activated clamping mechanisms, such as the pneumatic actuators described above with round clamping disks 33. Other clamping mechanisms, such as those described above, may be used. The two clamps of the transfer clamp 30 are preferably positioned to grab adjacent to but inside of the two clamps of the moveable clamp 26. The two clamps of the transfer clamps 30 may be located in other positions relative to the moveable clamp 26. Preferably, the two clamps of the transfer clamp 30 are spaced sufficiently to pull the laundry article over each side of the spreader in-feed 32. The two clamps grip by pulling the clamping disk 33 against the transfer clamp 30.

A rodless air cylinder 31 is used to move the transfer clamp 30 horizontally away from the moveable clamp 26 and towards an in-feed 32 of the separator apparatus 18 (FIGS. 1 and 2). Pneumatic or electrical mechanisms for moving the transfer clamp may be provided. The transfer clamp 30 moves the laundry article horizontally over the spreader bar of the in-feed 32 for release to the spreader apparatus 18.

Other transfer clamp mechanisms may be used for providing the article of laundry to the spreader apparatus 18. For example, the moveable clamp 26 may move upwards and then back towards the spreader apparatus 18 without providing for any secondary clamps.

Referring now to FIGS. 1 through 3, the in-feed 32 of the spreader apparatus 18 preferably comprises the spreader bar and associated pinch rollers or another apparatus used as an in-feed to the spreader disclosed in U.S. Pat. No. 5,515,627, the disclosure of which is herein incorporated by reference. Other spreader apparatus may be used, such as not yet developed or other spreaders capable of receiving a laundry article with only an area adjacent an edge identified and then locating the corners and spreading the laundry article automatically.

Two user stations are shown for the feeder 14. Each station includes a target 24 and associated moveable clamp 26. Multiple stations may allow for more efficient throughput of the spreader apparatus 18. Each user station alternately provides laundry articles to the in-feed 32 of the spreader apparatus 18. In alternative embodiments, only one or three or more user stations are provided on the feeder apparatus 14 for use by one or more spreader apparatus 18.

In operation, the user obtains an article of laundry and drapes the article over the target 24 or loads the article directly into the moveable clamp 26 by sliding an edge of the article up the target 24 until stopped by the brackets 52 and detected by the sensor 56. For draping, an area near an edge is located and draped over the target 24, so that an edge and some of the article of laundry are on the back side of the target 24 and the majority of the laundry article hangs on the front side of the target 24. During the draping process, the moveable clamp 26 is either transferring another article of laundry, returning to the target 24, loading the transfer clamp 30 or at rest adjacent the target 24. If the moveable clamp 26 is at rest adjacent the target 24, the user preferably loads the article directly into the moveable clamp 26.

Once the user has draped the laundry article over the target 24 or inserted the article in the moveable clamp 26, the moveable clamp 26 is activated to close in the appropriate position to grip the article. For example, the sensor 56 causes the moveable clamp 26 to close. Where the moveable clamp 26 is not in position to grip the article, the moveable clamp 26 moves to the gripping position to grip the article. In alternative embodiments, the user presses on activation button to cause the moveable clamp 26 to move and/or grip the article.

Upon activation, the motor 42 is electrically powered to move the belt 44 in a direction driving the clamp 26 towards the target 24. The clamp 26 stops moving upon being placed adjacent the target 24. The laundry article sensor 56 senses that an article of laundry is draped over the target 24, so the pneumatic activators 50 are used to clamp the laundry article in two places corresponding to the notches 34. The laundry article is clamped near but spaced from the edge.

If no sheet is detected by the laundry article sensor 56, the moveable clamp 26 remains adjacent to the target 24. In alternative embodiments, the moveable clamp 26 is moved away from the target 24. In either embodiment, if the laundry article slipped or otherwise fell off of the target 24, the moveable clamp 26 waits for another loading attempt.

Once the laundry article is clamped by the moveable clamp 26, the motor 42 is inverted to move the belt 44 in an opposite direction so that the moveable clamp 26 moves away from the target.

The moveable clamp 26 is propelled until the proximity sensor 66 detects the moveable clamp 26. Detection of the moveable clamp 26 activates the transfer clamp 30 and then stalls the motor 42. The transfer clamp 30 is moved forward towards the laundry article to an outwardmost position. The transfer clamp 30 clamps the laundry article in a position adjacent to the moveable clamp 26. Thus, the transfer clamp 30 holds the article of laundry near an edge.

The transfer clamp 30 is then withdrawn from the moveable clamp 26 towards the spreader apparatus 18. The transfer clamp 30 drags the laundry article over the in-feed 32 of the spreader apparatus. At a predetermined position, such as after the laundry article has entered the pinch rollers of the spreader apparatus 18, the transfer clamp 30 releases the article of laundry. At the time of release, a blast of air is used to force the article into the pinch rollers. Preferably, the pinch rollers are continuously active to grab and transport the article within the spreader apparatus 18. In alternative embodiments, the pinch rollers may stall or be inactive for a period of time, and the article is maintained at the in-feed during this period.

The moveable clamp 26 and/or transfer clamp 30 may be controlled to synchronize release with the operation of the spreader apparatus 18. For example, a sensor on the in-feed 32 indicates when transfer clamp 30 can deliver another article. Preferably, all of the components are synchronized or otherwise controlled to account for different operating times or jams. For example, the sensor 66 indicates when an article is ready for transfer by the transfer clamp 30.

Since the operator does not have to locate corners of the laundry article, laundry articles are spread more efficiently. Since multiple targets 24 may be used for multiple user stations, the throughput capabilities of the spreader apparatus may be more efficiently used. Since the moveable clamp 26 of the feeder apparatus 14 moves upwards from the target 24, the spreading apparatus may be mounted higher from the floor, allowing the spreading and subsequent laundry processing of larger laundry articles, such as king size sheets. The ability to load using the target 24 or the moveable clamp 26 may increase throughput. This loading process and transfer clamps 30 more likely provide the article in a straight alignment (leading edge aligned) to the spreader apparatus 18, so articles loaded off-center are more likely properly spread (a trailing corner is placed on each side of the in-feed 32).

While the invention has been described above by reference to the various embodiments, it will be understood that many changes and modifications can be made without departing from the scope of the invention. For example, different known or yet to be developed clamping mechanisms, devices for moving the clamps, and devices for guiding the moveable clamp 26 may be used. Furthermore, any of various materials for the components of the feeder apparatus 14 may be used.

It is therefore intended that the foregoing detailed description be understood as an illustration of the presently preferred embodiment of the invention and not as a definition of the invention. It is only the following claims, including all equivalents that are intended to define the scope of this invention.

What is claimed is:

1. A laundry feeder apparatus for processing laundry articles, the apparatus comprising:

a support;

a fixed target connected with the support, the fixed target comprising back and front sides adapted to allow a laundry article to drape over both the back and front sides; and a clamp moveably connected with the support and operable to clamp a laundry article draped on the fixed target.

2. The apparatus of claim 1 wherein:

the fixed target has at least two notches; and the clamp comprises at least two clamps, each clamp positionable at a respective one of the at least two notches.

3. The apparatus of claim 1 wherein the fixed target comprises a horizontally positioned plate.

4. The apparatus of claim 1 further comprising a second fixed target adjacent to the fixed target connected with the support.

5. The apparatus of claim 1 further comprising a track connected with the support wherein the clamp is moveably connected with the track.

6. The apparatus of claim 5 further comprising a second clamp, the second clamp positioned adjacent a first end of the track and the fixed target positioned adjacent a second end of the track, the second clamp operable to receive the laundry article from the clamp.

7. The apparatus of claim 1 further comprising a spreader apparatus, wherein the clamp is operable to move the laundry article from the target to adjacent the spreader apparatus.

8. The apparatus of claim 1 further comprising a laundry article sensor adjacent the fixed target.

9. The apparatus of claim 8 wherein:

the fixed target has a notch;

the laundry article sensor comprises a light beam sensor aimed through the notch.

10. A method for feeding laundry articles, the method comprising the steps of:

(a) draping a laundry article over a fixed target;

(b) clamping the draped laundry article with a clamp; and (c) moving the clamp and clamped laundry article away from the target.

11. The method of claim 10 wherein step (a) comprises placing an edge of the laundry article on a back side of the fixed target with a majority of the laundry article hanging from a front side of the fixed target.

12. The method of claim 10 wherein step (b) comprises clamping the draped laundry article in two locations near an edge of the laundry article.

13. The method of claim 12 wherein step (b) comprises clamping the draped laundry article in the two locations, the two locations being spaced from and not including the edge but closer to the edge than another edge of the laundry article.

14. The method of claim 10 wherein step (c) comprises moving the clamp and the laundry article upwards.

15. The method of claim 14 wherein step (c) comprises moving the clamp and the laundry article upwards to a spreader apparatus.

16. The method of claim 10:

wherein step (c) comprises moving the laundry article to a second clamp;

further comprising:

(d) clamping the laundry article with the second clamp; and (e) moving the laundry article to a spreader apparatus with the second clamp.

17. A method for feeding laundry articles, the method comprising the steps of:

(a) providing a fixed target operable to have a laundry article draped over the fixed target by a user;

(b) clamping the draped laundry article at a portion being spaced from each edge of the laundry article without clamping the edges; and (c) moving the clamped laundry article away from the target.

18. An apparatus for feeding a laundry article placed by a user, the apparatus comprising:

a target operable to receive the laundry article; and a moveable clamp operable to clamp a portion of the laundry article on the target without clamping edges of the laundry article.

19. The apparatus of claim 18 wherein the target comprises a fixed target.

20. The apparatus of claim 18 wherein:

the target has at least two notches; and the moveable clamp comprises at least two clamps, each clamp positionable at a respective one of the at least two notches.

21. The apparatus of claim 18 further comprising:

a second target adjacent to the target connected with the support;

a second moveable clamp;

a spreader in-feed;

a first track operative to guide the moveable clamp from the target to the spreader in-feed; and a second track operative to guide the second moveable clamp from the second target to the spreader in-feed.

22. The apparatus of claim 21 further comprising a transfer clamp, the transfer clamp positioned adjacent the spreader in-feed and one end of each of the first and second tracks, the transfer clamp operable to receive laundry articles from the moveable and second moveable clamps and to transfer the laundry articles to the spreader in-feed.

23. The apparatus of claim 18 further comprising a spreader apparatus, wherein the moveable clamp is operable to move the laundry article from the target to adjacent the spreader apparatus.

24. The apparatus of claim 18 further comprising a laundry article sensor adjacent the target.

25. A method for feeding laundry articles, the method comprising the steps of:

(a) optionally performing one of: draping a laundry article over front and back sides of a target and inserting the laundry article into a clamp wherein both options are available;

(b) clamping the laundry article; and (c) moving the clamp and the laundry article to a spreader.

26. A laundry feeder apparatus for processing laundry articles, the apparatus comprising:

a support;

a fixed target connected with the support, the fixed target having a notch;

a laundry article sensor adjacent the fixed target comprising a light beam sensor aimed through the notch; and a clamp moveably connected with the support and operable to clamp a laundry article draped on the fixed target.

27. A laundry feeder apparatus for processing laundry articles, the apparatus comprising:

a support;

a fixed target connected with the support, the fixed target comprising an upper portion adapted to allow a laundry article to drape over and around the upper portion; and a clamp moveably connected with the support and operable to clamp a laundry article draped on the fixed target.

28. A laundry feeder apparatus for processing laundry articles, the apparatus comprising:

a support;

a fixed target connected with the support; and a clamp moveably connected with the support, operable to clamp a laundry article draped on the fixed target, and operable to move with the laundry article away from the fixed target.

29. A method for feeding laundry articles, the method comprising the steps of:

(a) draping a laundry article over back and front sides of a fixed target;

(b) clamping the draped laundry article with a clamp; and (c) moving the clamped laundry article away from the target.

* * * * *